US010602836B1

(12) United States Patent
Mehra et al.

(10) Patent No.: US 10,602,836 B1
(45) Date of Patent: Mar. 31, 2020

(54) TOOTHBRUSH WITH FOAM CLEANING COLUMN

(71) Applicant: HAYDEN PRODUCTS LLC, New York, NY (US)

(72) Inventors: Curan Mehra, New York, NY (US); Alan Trojanowski, New York, NY (US)

(73) Assignee: HAYDEN PRODUCTS LLC, New York, NY (US)

( * ) Notice: Subject to any disclaimer, the term of this patent is extended or adjusted under 35 U.S.C. 154(b) by 0 days.

(21) Appl. No.: 16/298,372

(22) Filed: Mar. 11, 2019

(51) Int. Cl.

| | |
|---|---|
| ***A46B 9/04*** | (2006.01) |
| ***A46B 9/06*** | (2006.01) |
| ***A46B 9/00*** | (2006.01) |
| ***A46B 9/02*** | (2006.01) |

(52) U.S. Cl.
CPC ..... *A46B 9/005* (2013.01); *A46B 9/028* (2013.01); *A46B 9/04* (2013.01); *A46B 9/06* (2013.01); *A46B 2200/1066* (2013.01)

(58) Field of Classification Search
CPC ..... A46B 9/005; A46B 9/04; A46B 9/06
USPC ..... 15/110, 244.1, 244.2, 244.3
See application file for complete search history.

(56) References Cited

U.S. PATENT DOCUMENTS

| | | | | |
|---|---|---|---|---|
| 3,271,805 A | | 9/1966 | Sawyer | |
| 3,458,268 A | | 7/1969 | Wozab et al. | |
| 3,491,396 A | | 1/1970 | Eannarino et al. | |
| 4,183,684 A | * | 1/1980 | Avery, Jr. | A45D 34/04 15/244.1 |
| 4,335,731 A | | 6/1982 | Bora, Jr. | |
| 4,628,564 A | * | 12/1986 | Youssef | A46B 9/005 15/110 |
| 5,058,233 A | * | 10/1991 | Davis, III | A47L 13/16 15/228 |
| 5,875,510 A | | 3/1999 | Lamond et al. | |

(Continued)

FOREIGN PATENT DOCUMENTS

| | | |
|---|---|---|
| CN | 85204633 U | 12/1986 |
| CN | 2516021 Y | 10/2002 |

(Continued)

OTHER PUBLICATIONS

UT-250 Ultra Sonic Electronic Toothbrush User Manual Asahi Irika Co. Ltd.; (https://fccid.io/QRWUT-250/User-Manual/User-Manual-291084) last modified Dec. 2002.

*Primary Examiner* — Randall E Chin
(74) *Attorney, Agent, or Firm* — Martin & Ferraro, LLP

(57) ABSTRACT

A toothbrush having a cleaning column is provided. The toothbrush includes a handle portion, a neck portion, and a head portion. The cleaning column is attached to the head portion and extends away from an upper surface of the head portion. The cleaning column includes a cleaning surface for contacting a user's teeth. In one preferred embodiment, the cleaning surface can be made of foam that is formed via a reticulation process that exposes connected skeletal strands and the broken skeletal strands each having at least one free end of the foam. The connected skeletal strands and the broken skeletal strands of foam can facilitate the cleaning of the user's teeth, and the areas of the foam between the connected skeletal strands and the broken skeletal strands can facilitate holding of dentifrice therein.

25 Claims, 15 Drawing Sheets

(56) References Cited

U.S. PATENT DOCUMENTS

| | | | | |
|---|---|---|---|---|
| 5,967,152 | A * | 10/1999 | Rimkus | A46B 9/026 132/308 |
| 6,015,293 | A * | 1/2000 | Rimkus | A46B 9/026 132/309 |
| 6,067,684 | A | 5/2000 | Kweon | |
| 6,098,313 | A | 8/2000 | Skaja | |
| 6,237,183 | B1 | 5/2001 | Fischer | |
| 7,137,166 | B1 | 11/2006 | Kraemer | |
| 9,210,995 | B2 | 12/2015 | Su et al. | |
| 9,770,090 | B2 | 9/2017 | Chen | |
| 2002/0124337 | A1* | 9/2002 | Calabrese | A46B 9/005 15/110 |
| 2002/0138929 | A1* | 10/2002 | Mehta | A46B 9/02 15/110 |
| 2012/0272469 | A1 | 11/2012 | Kwon et al. | |

FOREIGN PATENT DOCUMENTS

| | | | |
|---|---|---|---|
| CN | 2556994 | Y | 6/2003 |
| CN | 1491607 | A | 4/2004 |
| CN | 201274866 | Y | 7/2009 |
| CN | 103783804 | A | 5/2014 |
| CN | 106213767 | A | 12/2016 |
| DE | 29816488 | U1 | 12/1998 |
| GB | 1265270 | | 3/1972 |
| JP | 2005270567 | A | 10/2005 |
| JP | 2014121368 | A | 7/2014 |
| JP | 2014121498 | A | 7/2014 |
| JP | 2017170103 | A | 9/2017 |
| KR | 2007050030 | A | 5/2007 |
| WO | 2006101286 | A1 | 9/2006 |

* cited by examiner

TOOTHBRUSH WITH FOAM CLEANING COLUMN

FIELD

The present technology is generally related to a toothbrush with a cleaning surface made of foam.

BACKGROUND

Effective toothbrushing involves the removal of debris, plaque, and discoloration from teeth and gums without causing damage. The cleaning surface of a conventional toothbrush is generally comprised of tufts of bristles/filaments, which transfer force through the ends to the teeth and gums to dislodge or break up debris and plaque. These bristle/filament ends do not easily conform to the irregular surface of the teeth and thus the conventional toothbrush design is not optimal for effective teeth cleaning. The bristles/filaments of a conventional toothbrush are also generally made of hard polymers such as nylon that can damage teeth and gums by abrading or scratching. Manufacturers of conventional toothbrushes have tried to address concerns about abrasion and scratching with various treatments of the bristles, such as end-rounding, or various compositions to reduce the hardness of the polymer, but even with these techniques, the conventional toothbrush design still poses risk of damage to the teeth and gums.

In addition to these limitations on cleaning and the risks of tooth and gum damage, the end portions of the bristles/filaments also do not effectively retain and distribute dentifrice during brushing. Instead, a substantial portion of the applied dentifrice (and its corresponding cleaning power) is typically lost after the first few movements of a conventional toothbrush. These inefficiencies can further promote overbrushing which leads to further undesirable abrading or scratching of the teeth and gums.

The toothbrush according to the present invention overcomes these deficiencies of conventional toothbrushes by incorporating a cleaning surface made of foam. The foam provides superior cleaning to the traditional bristles, while at the same time reducing the risk of abrading and scratching the teeth and gums. The foam cleaning surface of a preferred embodiment of the invention is formed by reticulation, a process that exposes connected skeletal strands and broken skeletal strands within the foam structure, resulting in a large number of small bristle-like elements. These elements better conform to the uneven surface of the teeth than the bristles/filaments of conventional toothbrushes, resulting in more uniform coverage of the teeth by the cleaning surface and thus more effective cleaning. The cleaning surface of the foam is also softer than the bristles/filaments of a conventional toothbrush and therefore also poses a lower risk of abrasion and other damage to the teeth and gums. As an additional benefit, areas of the foam between the connected skeletal strands and the broken skeletal strands create pocket-like spaces and thus the structure of the toothbrush of the present invention retains more of the dentifrice. This also contributes to more effective toothbrushing and reduces potential damage from overbrushing.

SUMMARY

The techniques of this invention generally relate to a toothbrush employing a cleaning surface made of foam.

In one embodiment, the present invention includes a toothbrush including a first end and an opposite second end, and a mid-longitudinal axis extending through the first end and the second end; a handle portion extending from the first end toward the second end, the handle portion having an upper surface and an opposite lower surface; a head portion extending from the second end toward the first end, the head having an upper surface and an opposite lower surface: and a cleaning column extending away from the upper surface of the head portion and being attached to the head portion, the cleaning column having a lower surface attached to the head portion and an upper surface for contacting a user's teeth, the cleaning column including an upper portion including the upper surface formed of a polyurethane foam having a reticulated cell structure at the upper surface.

In another embodiment, the present invention includes a toothbrush including a first end and an opposite second end, and a mid-longitudinal axis extending through the first end and the second end; a handle portion extending from the first end toward the second end, the handle portion having an upper surface and an opposite lower surface, a head portion extending from the second end toward the first end, the head having an upper surface and an opposite lower surface; and a cleaning column extending away from the upper surface of the head portion and being attached to the head portion, the cleaning column having a lower surface attached to the head portion and an upper surface for contacting a user's teeth, the cleaning column including an upper portion including the upper surface formed of a polyurethane foam having a reticulated cell structure at the upper surface with free strands adapted to clean teeth; and a base portion attached to the upper portion and being positioned between the head portion and the upper portion, the base portion being formed of an elastomeric polymer.

The details of one or more aspects of the invention are set forth in the accompanying drawings and the description below. Other features, objects, and advantages of the techniques described in this disclosure will be apparent from the description and drawings, and from the claims.

DETAILED DESCRIPTION

Figure 1A:
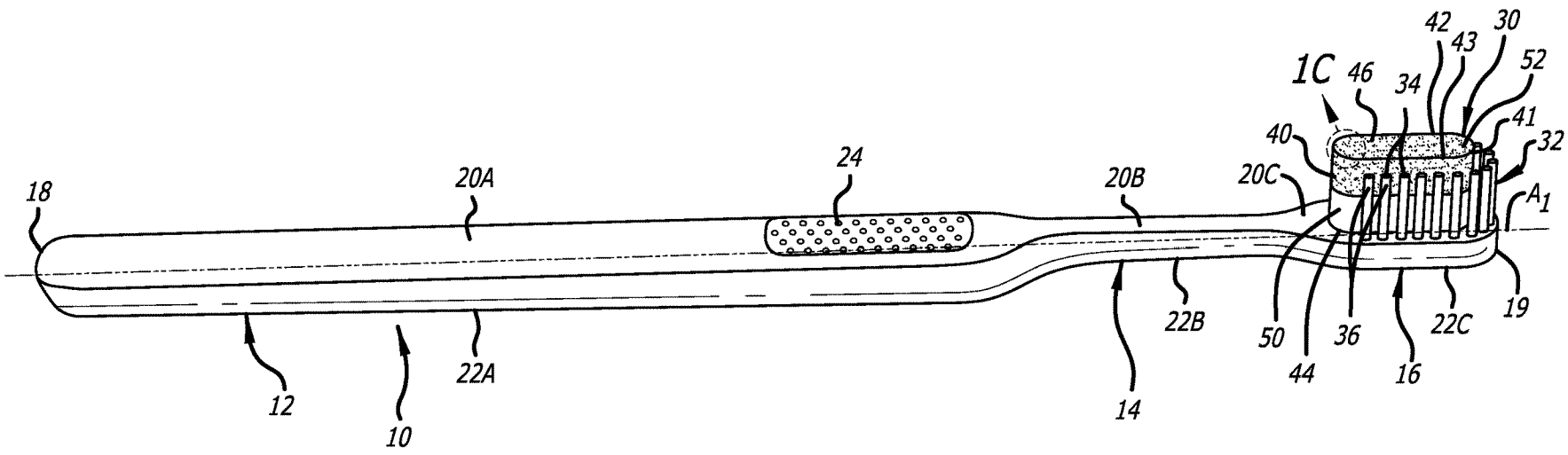
FIG. 1A is a top, side perspective view that illustrates an embodiment of a toothbrush with a cleaning column.
Figure 2:
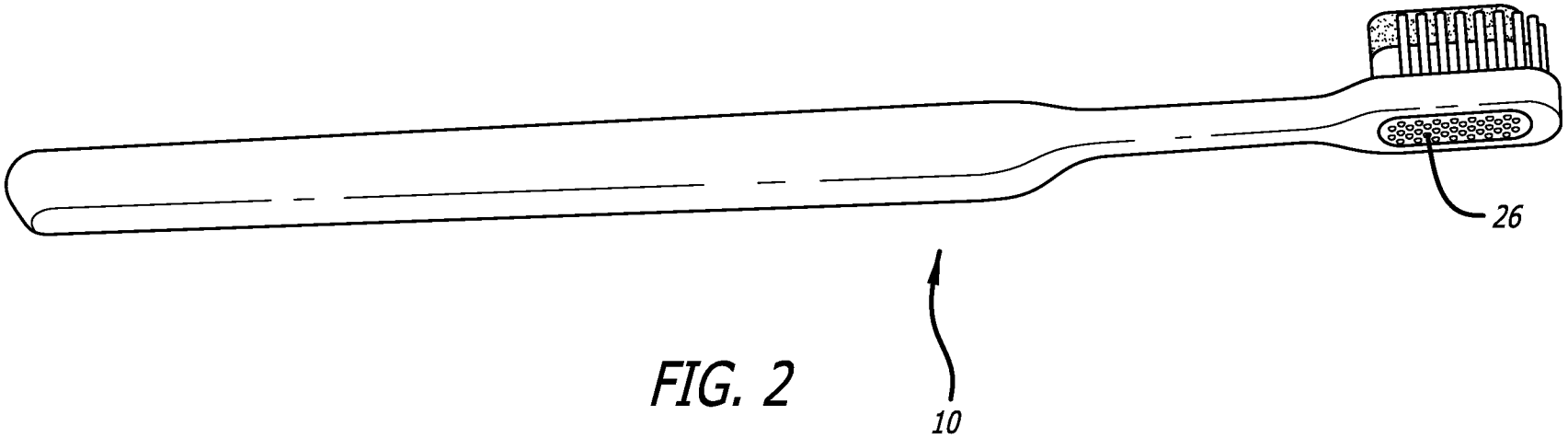
FIG. 2 is a bottom, side perspective view that illustrates the toothbrush of FIG. 1A.

A toothbrush according to an embodiment of the present invention is generally indicated by the numeral 10 in FIGS. 1A and 2. The toothbrush 10 includes a handle portion 12, a neck portion 14, and a head portion 16. The toothbrush 10 includes a first end 18, an opposite second end 19, and a mid-longitudinal axis $A_1$ extending through the first end 18 and the second end 19. The handle portion 12 extends from the first end 18 of the toothbrush 10 to the neck portion 14. The neck portion 14 extends from the handle portion 12 to the head portion 16, and the head portion 16 extends from the neck portion 14 to the second end 19 of the toothbrush 10. The handle portion 12, the neck portion 14, and the head portion 16 can be formed unitarily with one another or in separate pieces. The handle portion 12, the neck portion 14, and the head portion 16 can take many different forms and shapes, and FIGS. 1A and 2 are for illustrative purposes only. For example, the head portion 16 could be elongated, as shown in FIGS. 1A and 2, or it could take a more ovoid, elliptical, or round/rounded shape. As such, there are numerous configurations for the shape of the head portion 16, and the head portion 16 is not limited to the shape depicted in FIGS. 1A and 2.

The handle portion 12, the neck portion 14, and the head portion 16 includes upper surfaces 20A, 20B, and 20C and lower surfaces 22A, 22B, and 22C, respectively. The upper surface 20A and the lower surface 22A of the handle portion 12 can include gripping portions facilitating holding of the handle portion 12. To illustrate, as depicted in FIG. 1A, the upper portion 20A includes a gripping portion 24. Furthermore, the upper surface 20C of the head portion 16 includes various teeth cleaning structures disposed thereon, and the lower surface 22C of the head portion, as depicted in FIG. 2, can include a tongue scraper 26.

The various teeth cleaning structures disposed on the upper surface 20C may include one or more cleaning columns 30 and a set 32 of tufts of cleaning bristles or filaments 34. The cleaning column 30 and the set 32 of tufts of cleaning bristles 34 can be used as part of an electrified toothbrush where at least one of the cleaning column 30 and the set 32 of tufts of cleaning bristles 34 is agitated to further aid cleaning of teeth using these cleaning structures.

As depicted in FIG. 1A, in one embodiment, the cleaning column 30 is positioned in the center of the upper surface 20C, and the long horizontal axis of the cleaning column 30 in FIG. 1A is substantially aligned with the mid-longitudinal axis $A_1$ of the toothbrush 10. In other embodiments, the cleaning column 30, like the head portion 16, could take a more ovoid elliptical, or round/rounded shape. As such, there are numerous configurations for the shape of the cleaning column 30, and the cleaning column 30 is not limited to the shape depicted in FIG. 1A. Furthermore, there are also numerous possible configurations for the set 32 of tufts of cleaning bristles 34. For example, the tufts of cleaning bristles 34 could completely surround the cleaning column 30, and/or the tufts of cleaning bristles 34 could be arranged along the longitudinal axis $A_1$ of the toothbrush 10 with a first cleaning column 30 positioned on a first side of the tufts of cleaning bristles 34, and a second cleaning column 30 positioned on a second side of the tufts of cleaning bristles 34.

Furthermore, in one embodiment, each of the cleaning bristles extend upwardly from the upper surface 20C and terminate at end portions 36, and 200 or more of the cleaning bristles could be included in each of the tufts of cleaning bristles 34. There are numerous possible configurations for the cleaning bristles. For example, the cleaning bristles could be shorter than, taller than, identical to the height of the cleaning column 30, or some combination of profiles and heights relative to the cleaning column 30.

The cleaning column 30 of the example depicted in FIG. 1A includes a first end 40 oriented toward the first end 18 of the toothbrush 10, a second end 41 oriented toward the second end 19 of the toothbrush, a first lateral side 42 extending between the first end 40 and the second end 41, and a second lateral side 43 extending between the first end 40 and the second end 41. The set 32 of the tufts of cleaning bristles 34 can be arranged in various positions with respect to the cleaning column 30, such as adjacent to the first end 40, the second end 41, the first lateral side 42, and/or the second lateral side 43 of the cleaning column 30. The set 32 of the tufts of cleaning bristles 34 can be positioned to completely or partially surround the cleaning column 30. Alternatively, the cleaning column 30 could surround the tufts of cleaning bristles 34. The number of the bristles in each of the tufts of cleaning bristles 34 preferably can range from as few as 10-30 bristles to as many as 300 bristles, and, although not all are shown in FIG. 1A, the set 32 includes 18 of the tufts of cleaning bristles 34 that are positioned partially around the cleaning column 30 along the second end 41, the first lateral side 42, and the second lateral side 43.

In addition to the first end 40, the second end 41, the first lateral side 42, and the second lateral side 43, the cleaning column includes a lower surface 44 and an upper surface 46. The lower surface 44 can be attached to the head portion 16 to facilitate attachment of the cleaning column 30 to the toothbrush 10, and the upper surface 46 is used as a cleaning surface for cleaning teeth to which the cleaning column 30 is contacted. To illustrate, the lower surface 44 can be attached to the upper surface 20C of the head portion 16 using adhesives, chemical bonding, mechanical fasteners, heating or welding (e.g., ultrasonic welding), press fit, snap fit, additional connective layer(s), or any other methods of joining different materials together. Alternatively, all or a portion of the cleaning column 30 can be integrally formed with the head portion 16.

The cleaning column 30 can be formed from a single material or multiple layers of the same or different materials or composites of the same or different materials. As depicted in FIGS. 1A, 2, 3 and 4, in one embodiment, the cleaning column 30 includes a first layer formed by a base portion 50 and a second layer formed by an upper portion 52. The lower surface 44 is formed on the base portion 50, and the upper surface 46 is formed on the upper portion 52. In one embodiment, the base portion 50 can be formed from a first polymeric material or composite of polymeric materials, and the upper portion 52 can formed from a second polymeric material or composite of polymeric materials. The second polymeric material or composite of polymeric materials of the upper portion 52 can be selected for teeth-cleaning properties at the upper surface 46 thereof, and the first polymeric material or composite of polymeric materials of the base portion 50 can be selected to facilitate support and use of the upper portion 52 during brushing. As such, the first and second polymeric materials or composites of polymeric materials can be selected to complement one another to facilitate cleaning of teeth during brushing by providing, for example, a cleaning surface and a firm structure supporting the cleaning surface.

While the base portion 50 and the upper portion 52 are shown having approximately the same height in FIGS. 1A, 2, 3 and 4, the base portion 50 and the upper portion 52 can vary in height with respect to one another. The base portion 50 and/or the upper portion 52 also can be made to focus on one or more of the below-discussed advantageous properties. For example, the base portion 50 can be made to facilitate attachment to the head portion 16 and the upper portion 52. Furthermore, additional layer(s) that supplement the base portion 50 and/or the upper portion 52 can also be used, and the additional layer(s) can be made to focus on one or more of the below-discussed advantageous properties. For example, the additional layer(s) can be used between the base portion 50 and the upper portion 52, and between the base portion 50 and the head portion to facilitate attachment therebetween. These additional layer(s) are connective layers(s) made of the first and second polymeric materials or composites of polymeric materials, and/or other polymeric materials. In one embodiment, these additional layers(s) could be substantially rigid connective layer(s) to facilitate attachment.

The first and second polymeric materials or composites of polymeric materials, for example, can be made of the same or different polymers that are subject to different manufacturing processes affecting the physical properties thereof. To illustrate, the first polymeric material or composite of polymeric materials forming the base portion 50 can be formed as a solid piece of the polymer(s), and the second polymeric material or composite of polymeric materials forming the upper portion 52 can be formed as a foam piece of the polymer(s). The solid piece of the base portion 50 and the foam piece of the upper portion 52, for example, can be created via extrusion processes, molding processes, and/or using die cutting on sheets of the polymeric materials.

The base portion 50 and the upper portion 52 can be attached to one another using adhesives, chemical bonding, mechanical fasteners, heating or welding (e.g., ultrasonic welding), press fit, snap fit, additional connective layer(s), pressure sensitive tape, or any other methods of joining different materials together. And the base portion 50 likewise can be attached to the head portion 16 using adhesives, chemical bonding, mechanical fasteners, heating or welding (e.g., ultrasonic welding), press fit, snap fit, additional connective layer(s), or any other methods of joining materials together.

The base portion 50 serves as a platform for supporting the upper portion 52, and has the below-discussed properties for facilitating support and use of the upper portion 52 during brushing. To that end, the first polymeric material or composite of polymeric materials forming the base portion 50 preferably can be an elastomeric thermoplastic selected to have the below-discussed advantageous properties including high elongation, high elasticity, high shear strength, high tensile strength, and low hardness. Alternate polymeric materials having these properties can also be used as well as other foam materials such as natural foams, sponges, or plant-based materials.

The first material, such as a polymeric material or composite of polymeric materials, used for the base portion 50 can have high elongation. Generally, the higher the elongation, the greater the resilience and flexible life thereof. A higher flexible life permits the base portion 50 to bend or give in response to an applied force without cracking or breaking over time. High elongation that affords bending or giving in response to an applied force (such as the force of brushing) can also serve in creating an adequate range of cushioning in response to the force of brushing as well as aiding in comformability of the top surface to the teeth contours. As such, the first polymeric material or composite of polymeric materials preferably has an elongation break of approximately 400% to 800% or more. Furthermore, the first polymeric material or composite of polymeric materials used for the base portion 50 can have high tensile strength. Generally, like having high elongation, the higher the tensile strength, the greater the resilience and flexible life thereof. A higher flexible life, as discussed above, permits the base portion 50 to bend or give in response to an applied force without cracking or breaking over time. Materials with low tensile may deteriorate in response to an applied force (such as the force of brushing). As such, the first polymeric material or composite of polymeric materials preferably has a tensile strength ranging from 0.5 to 6.0 MPa or more, with one preferred range of 0.5 to 3.5 MPa. The high elongation and high tensile strength afford high tear strength and correspondingly high tear resistance for the base portion 50.

Also, the first polymeric material or composite of polymeric materials used for the base portion 50 can have low hardness. A low hardness is important to cushioning and stability provided by the base portion 50 to afford for gentleness in brushing, but the first polymeric material or composite of polymeric materials also can have sufficient stiffness so that the cleaning column 30 does not compress at a meaningfully different rate than the set 32 of the tufts of cleaning bristles 34. To that end, the hardness of the first polymeric materials or composite of polymeric materials can be selected for their ability to calibrate compressibility of the cleaning column 30 to match compressibility of the set 32 of the tufts of cleaning bristles 34. As such, the first polymeric material or composite of polymeric materials preferably has an average hardness ranging from approximately Shore A 0 to 70, and more preferably an average hardness ranging from approximately Shore A 5 to 25.

Additionally, the first polymeric material or composite of polymeric materials used for the base portion 50 can have properties facilitating attachment of the base portion 50 to the upper portion 52 and to the head portion 16. To illustrate, if the upper portion 52 is made of polyurethane foam, the first polymeric material or composite of polymeric materials can be selected to have properties that facilitate attachment via heating or welding of the upper portion 52 to the base portion 50. For example, the first polymeric material or composite of polymeric materials can have a high melt flow index to more easily flow into pores of the polyurethane foam of the upper portion 52 during a heating process. The materials can also be attached by a welding process such as an ultrasonic welding process. Flow of melted portions of the base portion 50 into pores of the upper portion 52 can achieve a degree of mechanical interlocking between the base portion 50 and the upper portion 52. As such, the first polymeric material or composite of polymeric materials, at least at the surface touching the upper portion 52, preferably has a viscosity during heating or welding ranging from approximately 5 to 7 Pa·s apparent viscosity at 200 degrees C. and 11,200 1/second.

Other properties that the first polymeric material or composite of polymeric materials can include formability into the desired shape, abrasion resistance, tear resistance, ability to incorporate flavor or desirable odor, and/or colorization ability.

The foam piece of second polymeric material or composite of polymeric materials of the upper portion 52 is used to form the upper surface 46, and the upper surface 46 is used as a cleaning surface for cleaning teeth to which the upper surface 46 is contacted. The second polymeric material or composite of polymeric materials can have an ester polymer structure or alternatively an ether polymer structure. Preferably, the second polymeric material or composite of polymeric materials is polyurethane foam. The polyurethane foam of the second polymeric material or composite of polymeric materials preferably has high elasticity so that the upper portion 52 can deform to fit between teeth and gums under the force of bushing, and preferably has an extremely low durometer so that the upper surface 46 does not abrade or scratch of teeth and gums.

Figure 1B:
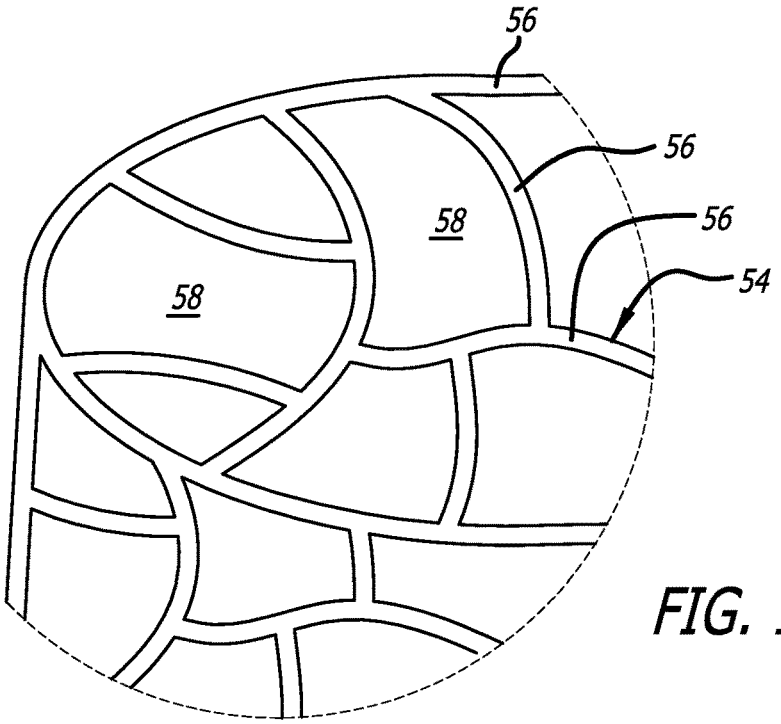
FIG. 1B is an enlarged view that illustrates a portion of a cleaning column.
Figure 1C:
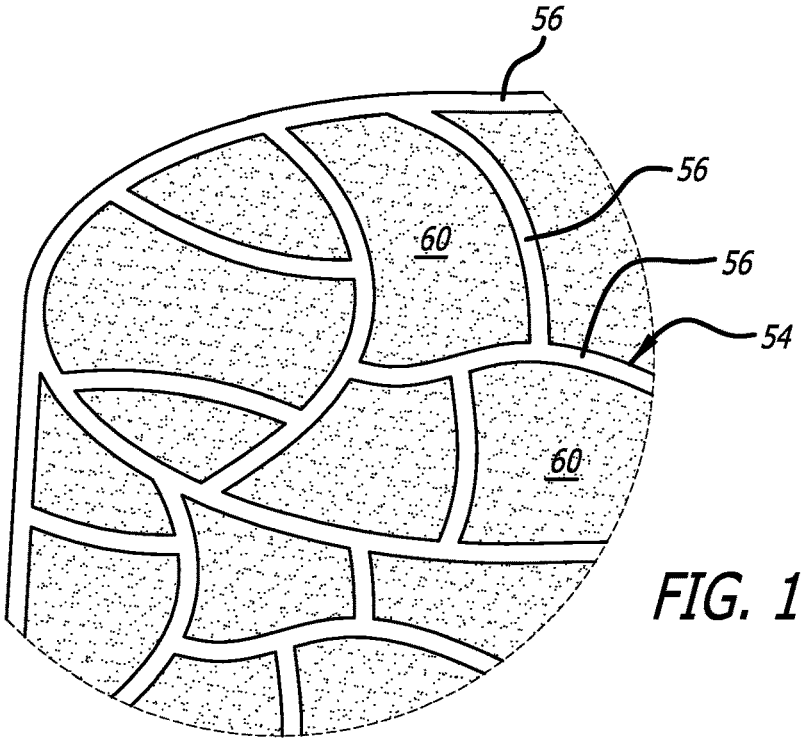
FIG. 1C is an enlarged view of FIG. 1A that illustrates a portion of the cleaning column.
Figure 1D:
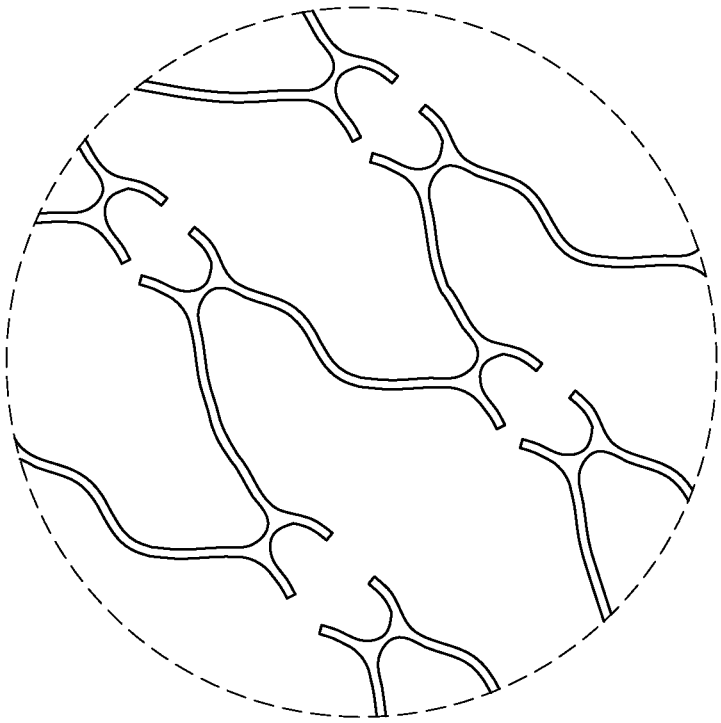
FIG. 1D is a microscopic photograph of a cleaning surface of the cleaning column of the toothbrush of FIG. 1A.

The foam piece forming the upper portion 52 can be fully or partially reticulated at the upper surface 46 to expose the skeletal structure of the foam. Polyurethane foam is generally composed of a web of cells or pores joined together. A reticulation process can be applied to the polyurethane foam piece forming the upper portion 52 to remove certain membranes of the cells or pores to expose a consistent or semi-consistent fine cell or pore structure. Such exposure results, as depicted in FIGS. 1B and 1C, in a skeletal structure of the foam as the upper surface 46. FIGS. 1B and 1C are illustrated representations of the skeletal structure which is referenced by the numeral 54 therein, and FIG. 1D is a microscopic photograph of an exemplary skeletal structure of one embodiment of the reticulated foam.

The skeletal structure 54 includes various skeletal strands 56, and, when the upper surface 46 is contacted to teeth, the skeletal strands 56 are effective in removing debris and plaque to clean the teeth. Although the skeletal strands 56 are depicted as being connected to one another as illustrated in FIGS. 1B and 1C, the skeletal strands are also broken during the reticulation process to create broken skeletal strands each having at least one free end as depicted in FIG. 1D. The connected skeletal strands and the broken skeletal strands are effective as teeth cleaners. Furthermore, the skeletal structure 54 can generate a capillary effect using water applied during brushing to draw the debris and plaque into the skeletal structure 54 and away from the teeth.

Also, as depicted in FIG. 1C, after the reticulation process, areas 58 between the skeletal strands 56 can be filled with a dentifrice 60 to aid the cleaning of teeth. The dentifrice 60 can be applied to the upper surface 46 to fill the areas 58. Furthermore, the capillary effect created by the skeletal structure 56 can be used to draw the dentifrice, as well as the debris and plaque, into the foam piece forming the upper portion 52.

The dentifrice 60 also can be mixed with the second polymeric material or composite of polymeric materials prior to or during formation of the polyurethane foam piece forming the upper portion 52.

Pores per linear inch (PPI) of at least about 70 PPI and ranging from about 70 to about 140 in the polyurethane foam piece are preferred for the upper portion 52. Such foam would preferably have a density ranging between about 1 to about 8 lb/ft$^3$. Additional preferred ranges of the PPI for the polyurethane foam piece can be from about 100 PPI to about 130 PPI, from about 105 PPI to about 125 PPI, and from about 110 PM to about 120 PPI.

Foams with high PPI generally have a smaller pore structure and a smooth surface texture. Furthermore, foams with high PPI generally have less flow through than low PPI, and consequently, such foams will more effectively retain the dentifrice 60. Additional additives that can be used in place of or in addition to the dentifrice include antibacterial agents, surfactant agents, fluoride, flavoring substances, anti-yellowing agents, plaque indicators, or other formulations that may improve the teeth cleaning experience. Like the dentifrice 60, the other additional additives can be applied to the upper surface 46 or mixed with the second polymeric material or composite of polymeric materials prior to, during, and/or after formation of the polyurethane foam piece.

In addition to a reticulation process, compression and/or cutting processes can be used that provide the upper surface 46 with surface contours, shapes, and textures that can further aid the cleaning of teeth. Furthermore, nonwoven materials may be applied to portions of the upper surface 46 via a physical process such as lamination and/or impregnation to enhance the texture thereof, and the enhanced texture afforded by the addition of the nonwoven materials to the upper surface 46 can further aid the cleaning of teeth. Additionally, compression and/or cutting processes can be used to form apertures (not shown) through the upper surface 46 into the upper portion 52, and these apertures can be filled with the dentifrice 60 or the other additional additives.

In one embodiment, the cleaning column 30 can be made entirely or almost entirely out of a foam piece of the second polymeric material or composite of polymeric materials. Furthermore, all or portions of the foam piece of the second polymeric material or composite of polymeric materials could be processed to change various properties thereof to facilitate use as the cleaning column 30. To illustrate, a thermoforming process (such as, for example, foam felting or variable foam felting) could be used to increase the density and stiffness of at least a portion of the foam piece so that the denser/stiffer portion can serve as a platform for supporting the upper surface 46. The foam felting or variable foam process permanently compresses all or portions the foam piece to increase density and stiffness via heating of the foam piece to an optimum forming temperature and then compression of the foam piece using a platen. The compressed portions of the foam piece can be made to include properties similar to that of the base portion 50 including high elongation, high tensile strength, and low hardness. The compressed portions of the foam piece can also be made to include properties facilitating attachment to the head portion 16.

The variable felting process could also be used to compress exposed surfaces using a platen to increase the density and stiffness thereof, while leaving cell structure in the middle portions of the foam piece uncompressed. The uncompressed middle portions of the foam piece thus would be less dense and stiff than these compressed portions. The foam piece could then be cut apart to reveal the uncompressed middle portions of the foam and expose the connected skeletal strands and broken skeletal strands. One of the resulting portions of the foam piece could be die cut to form the cleaning column 30, and be attached to the head portion 16 such that the lower surface 44 thereof is formed from the compressed portions of the foam piece, and the upper surface 46 is formed from the uncompressed middle portions of the foam.

In one embodiment, these thermoforming processes (foam felting and variable foam felting) can be used on the foam piece of the second polymeric material or composite of polymeric materials to form the base portion 50 and/or the upper portion 52 of the cleaning column 30, and can be made to include the above-discussed properties of the base portion 50 or the upper portion 52.

Figure 3:
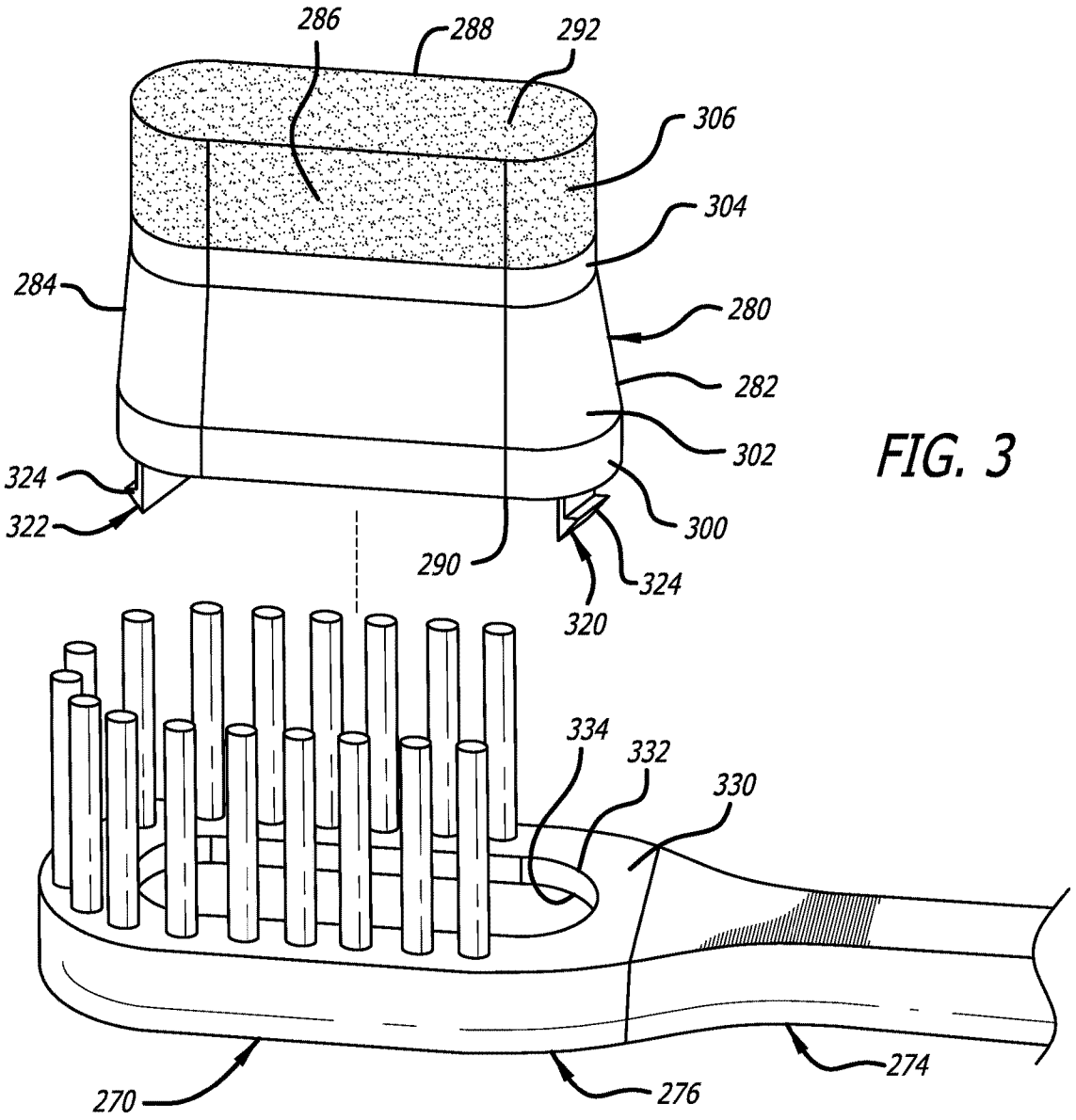
FIG. 3 is a top, side, exploded, partial perspective view that illustrates another embodiment of a toothbrush incorporating an embodiment of the cleaning column.
Figure 4A:
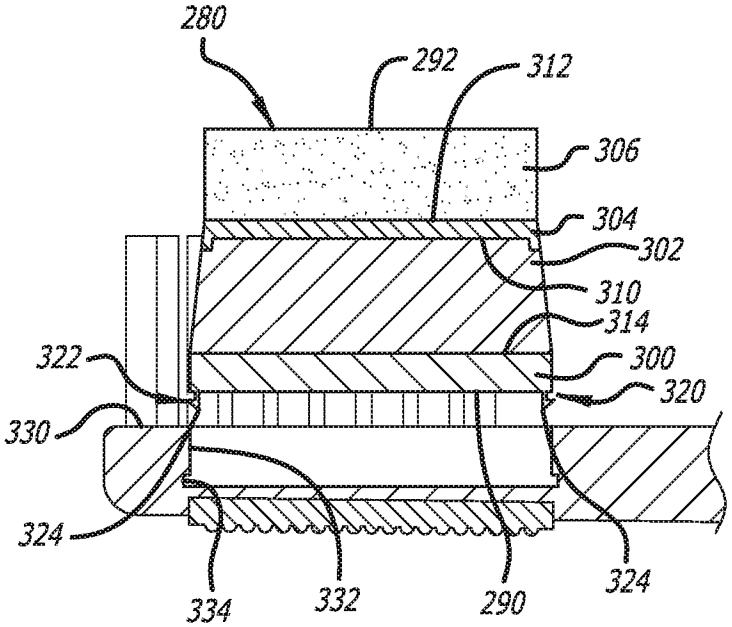
FIG. 4A is an exploded, partial, cross-sectional view of the toothbrush of FIG. 3 that illustrates the attachment of the cleaning column attached thereto.
Figure 4B:
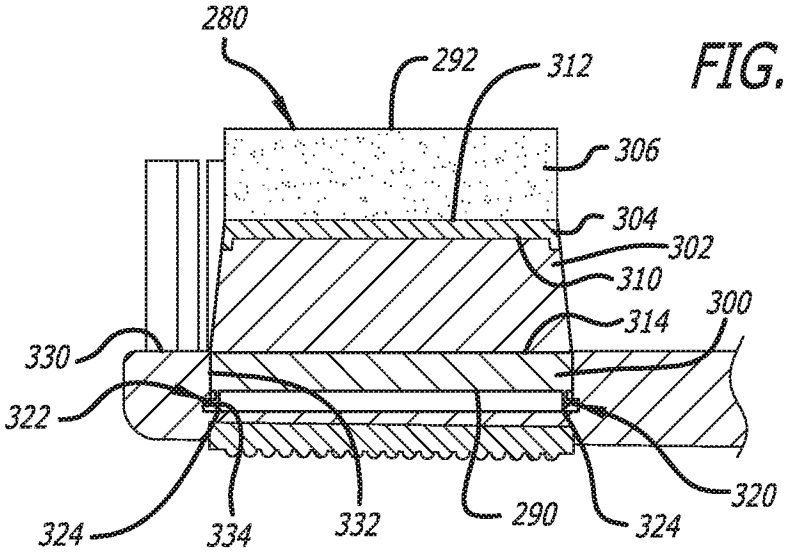
FIG. 4B is a partial, cross-sectional view of the toothbrush of FIG. 3 that illustrates the cleaning column attached to the toothbrush.

A toothbrush according to an embodiment of the present invention is generally indicated by the numeral 270 in FIGS. 3-4B. Like the toothbrush 10, the toothbrush 270 includes a handle portion (not shown), a neck portion 274, and a head portion 276. The head portion 276 of the toothbrush 270 can include the set 32 of the tufts of cleaning bristles or filaments 34 identical to that of the head portion 16 of the toothbrush 10. The head portion 276 includes an embodiment of a cleaning column generally indicated by the numeral 280. The cleaning column 280 can be permanently, semi-permanently, or removably attached to the head portion 276.

As depicted in FIGS. 3-4B, the cleaning column 280 includes a first end 282, a second end 284, a first lateral side 286, a second lateral side 288, a lower first surface 290, and an upper second surface 292. Like the upper surface 46, the upper second surface 292 is used in cleaning teeth to which the cleaning column 280 is contacted.

Like the cleaning column 30, the cleaning column 280 can be formed from a single material or multiple layers of different materials including one or more layers of different materials or composites of different materials. As depicted in FIGS. 3-4B, the cleaning column 280 includes first layer formed by a first base portion 300, a second layer formed by a second base portion 302, a third layer formed by an intermediate portion 304, and a fourth layer formed by an upper portion 306. The first base portion 300, the second base portion 302, the intermediate portion 304, and the upper portion 306 can be created using die cutting on sheets of the polymeric materials. Furthermore, the upper portion 306 can be similar to the upper portion 52 of the toothbrush 10, and the first base portion 300 and the second base portion 302 are tapered from the bottom to the top thereof.

The intermediate portion 304 can be formed from a relatively hard polymeric material to provide a firm attachment structure for attaching the second base portion 302 and the upper portion 306. The intermediate portion 304 includes a lower surface 310 and an upper surface 312, and the second base portion 302 and the upper portion 306 can be respectively attached thereto using adhesives, chemical bonding, mechanical fasteners, heating or welding (e.g., ultrasonic welding), press fit, snap fit, or any other methods of joining different materials together.

The first base portion 300 can also be formed from a relatively hard polymeric material to provide a firm attachment structure for attaching the second base portion 302 thereto, and to also facilitate attachment to the head portion 276. The first base portion 300 includes the lower first surface 290 of the cleaning column 280 and an upper surface 314. The second base portion 302 can be attached to the upper surface 314 using adhesives, chemical bonding, mechanical fasteners, heating or welding (e.g., ultrasonic welding), press fit, snap fit, or any other methods of joining different materials together.

As depicted in FIGS. 3-4B, the lower first surface 290 formed on the first base portion 300 can include a first detent 320 and a second detent 322 formed at the first end 282 and the second end 284, respectively, of the cleaning column 280. Each of the first detent 320 and the second detent 322 include tabs 324 formed thereon facilitating permanent, semi-permanent, or removable attachment of the cleaning column 280 to the head portion 276.

The head portion 276, as depicted in FIGS. 3-4B, includes an upper surface 330, a recess 332 formed through the upper surface 330, and a notch 334 formed in the recess 332. As depicted in FIGS. 3-4B, to attach the cleaning column 280 to the head portion 276, the first base portion 300 is inserted into the recess 332, and the detents 324 of each of the first detent 320 and the second detent 322 are received in the notch 334.

Figure 5:
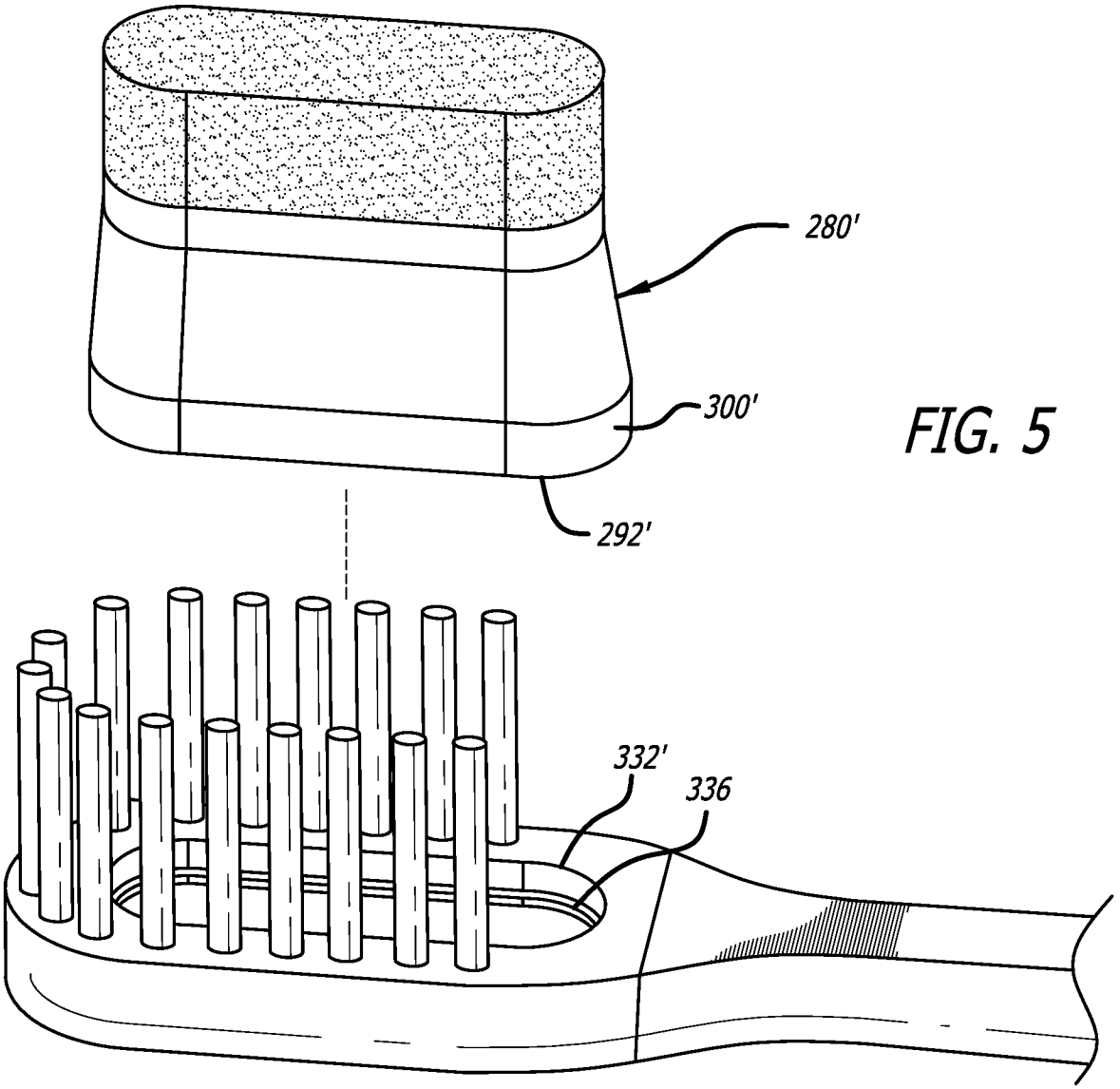
FIG. 5 is a top, side, exploded, partial perspective view that illustrates another embodiment of a toothbrush incorporating an embodiment of the cleaning column.
Figure 6B:
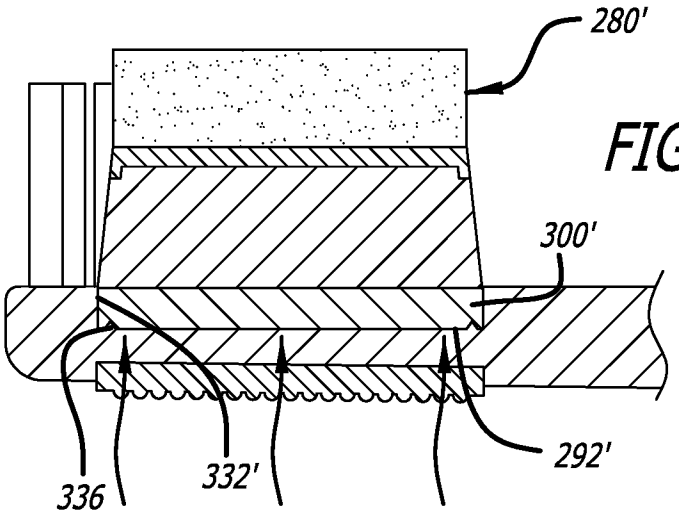
FIG. 6B is a partial, cross-sectional view of the toothbrush of FIG. 5 that illustrates the cleaning column attached to the toothbrush.
Figure 6A:
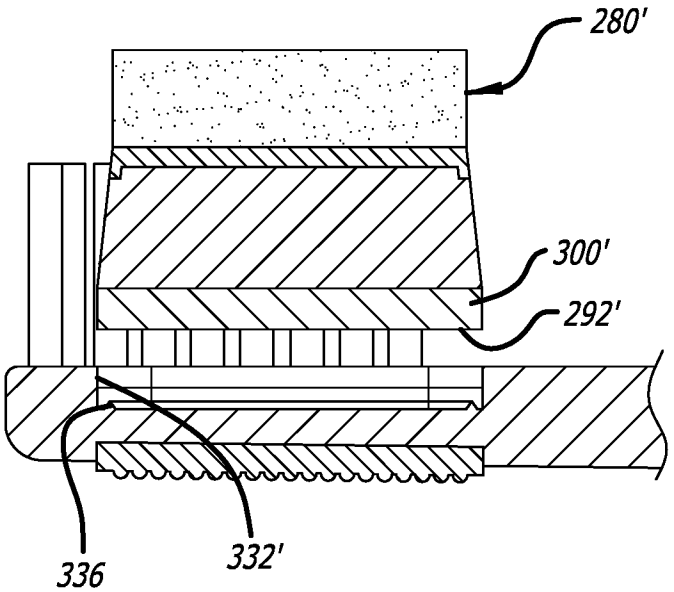
FIG. 6A is an exploded, partial, cross-sectional view of the toothbrush of FIG. 5 that illustrates the attachment of the cleaning column attached thereto.

The cleaning column 280 can be modified to be a cleaning column 280', as depicted in FIGS. 5-6B, including a first base portion 300' having a lower surface 292' that does not include the first detent 320 and the second detent 322, and the recess 332 can be modified to be a recess 332' that includes a protrusion 336. As depicted in FIGS. 5-6B, to attach the cleaning column 280' to the head portion 276, the first base portion 300' is inserted into the recess 332', and heat or other forms of welding, such as ultrasonic welding, can be applied to the head portion 276 to attach the first base portion 300' to the head portion 276 via a connection formed between the lower surface 292' and the protrusion 336. Like the cleaning column 280, the cleaning column 280' can be permanently, semi-permanently, or removably attached.

The attachment of the cleaning column 280' to the head portion 276 must be secure and must withstand the forces applied during brushing. The attachment process of attaching the cleaning column 280' to the head portion 276 must also be performed without damaging the bristles. In one preferred process for attaching the cleaning column 280' to the head portion 276, the first base portion 300' is made from the same material as the head portion and from a material suitable for both the head portion 276 and the first base portion 300'. Polypropylene, for example, is a material that can withstand the forces of brushing and tufting and would be a suitable material. In one preferred embodiment, the first base portion 300' of the cleaning column 280 and the head portion 276 would be made from polypropylene. In this preferred embodiment, the cleaning column 280' would be connected to the head portion 276 by an ultrasonic welding process without causing damage to other parts of an already formed toothbrush, such as the bristles. Specifically, an ultrasonic horn would contact the head portion 276 from the lower surface of the head portion 276 while at the same time a press would push the cleaning column 280' into the recess 322'. The recess in the head would contain an energy director or shear joint 332'. As the ultrasonic horn comes in contact with the head portion 276, it would rapidly vibrate causing the energy director or shear joint to begin to melt. As the plastic melts, a weld would be formed between the polypropylene of the cleaning column 280' and the polypropylene of the head portion 276 inside the recess 332, thereby producing a weld that is secure and a permanent attachment without damaging other parts of the toothbrush.

Figure 7A:
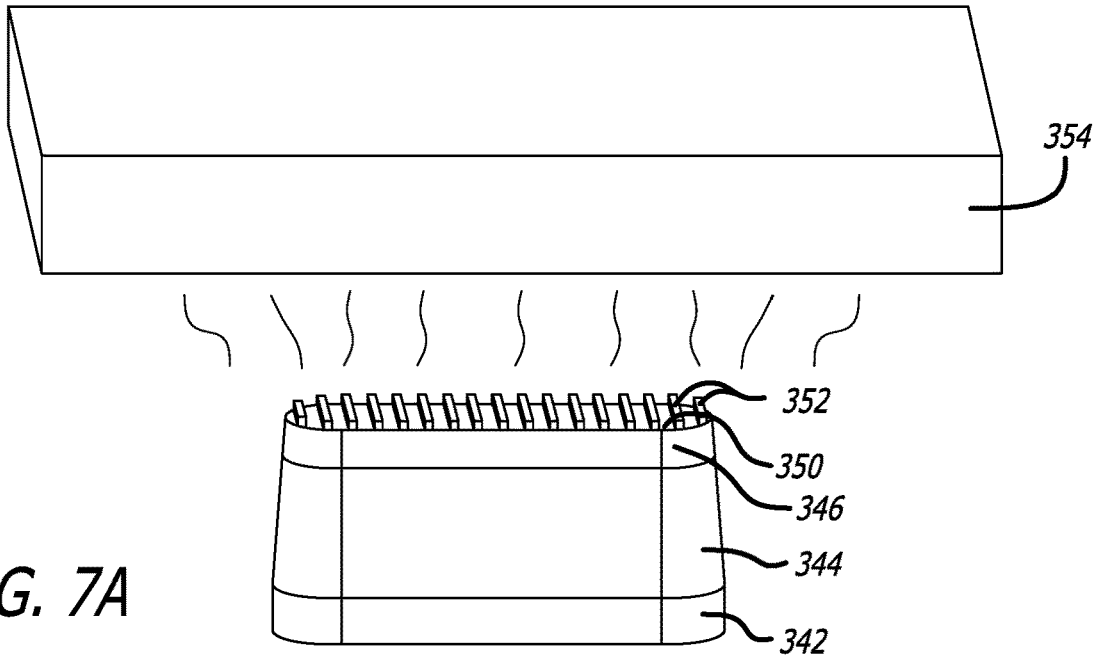
FIG. 7A is a perspective view that illustrates a portion of process for forming another embodiment a cleaning column.
Figure 7B:
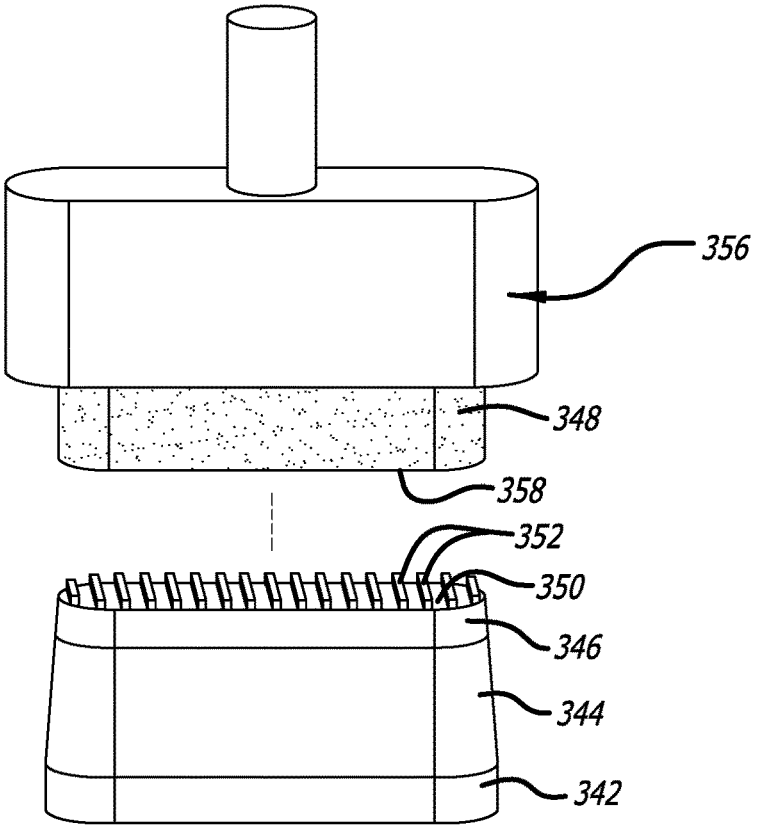
FIG. 7B is a perspective view that illustrates another portion of the process started in FIG. 7A.
Figure 8:
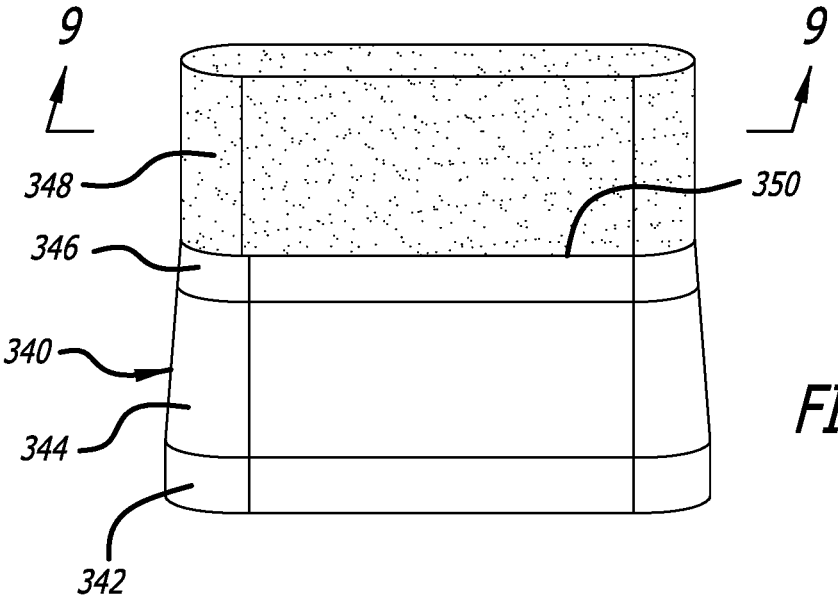
FIG. 8 is a perspective view that illustrates the embodiment of the cleaning column formed by the process of FIGS. 7A and 7B.
Figure 9:
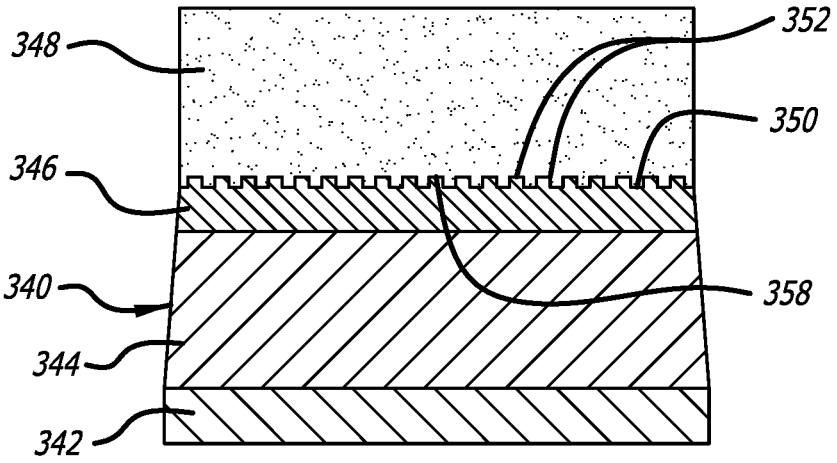
FIG. 9 is a cross-sectional view taken on Line 9-9 of FIG. 8 that illustrates the embodiment of the cleaning column formed by the process of FIGS. 7A and 7B.

FIGS. 7A-9 depict a cleaning column 340 (similar to cleaning columns 280 and 280'), and a method for assembling portions thereof. As depicted in FIGS. 8 and 9, the cleaning column 340 includes a first base portion 342, a second base portion 344, an intermediate portion 346, and an upper portion 348. The first base portion 342, the second base portion 344, the intermediate portion 346, and the upper portion 348 can be created using die cutting on sheets of the polymeric materials. The intermediate portion 346 includes an upper surface 350 having various ridges 352 formed thereon. As depicted in FIGS. 7A and 7B, the upper portion 348 (which can include the features of the upper portion 52) can be joined to the intermediate portion 346 by heating the upper surface 350 (and the ridges 352 formed thereon) using, for example, a heating plate 354 and/or heating the area between the intermediate portion 346 and the upper portion 348, and thereafter, pressing the upper portion 348 onto the upper surface 350 of the intermediate portion 346 using a press 356. The ridges 352 formed on the upper surface of the intermediate portion 346 facilitate welding because the ridges 352 create a thinner material that melts more rapidly than a relatively thicker material. For example, the upper surface 350 can be heated to a temperature of 460° C. for 7 seconds, and then the upper portion 348 can be pressed onto the upper surface 350 using the press 356 for 5 seconds. Other combinations of temperatures and time can be used to create the weld. The air pressure and dwell time can also be controlled to facilitate attachment of the upper portion 348 to the intermediate portion 346. As such, a lower surface 358 of the upper portion 348 would be attached by welding to the upper surface 350 of the intermediate portion 346. Melting of the upper surface 350 of the intermediate portion 346 causes portions of the upper surface 350 of the intermediate portion 346 to fill into spaces or pores in the foam of the lower surface 358 of the upper portion 348 to create an interlocking attachment.

Figure 10A:
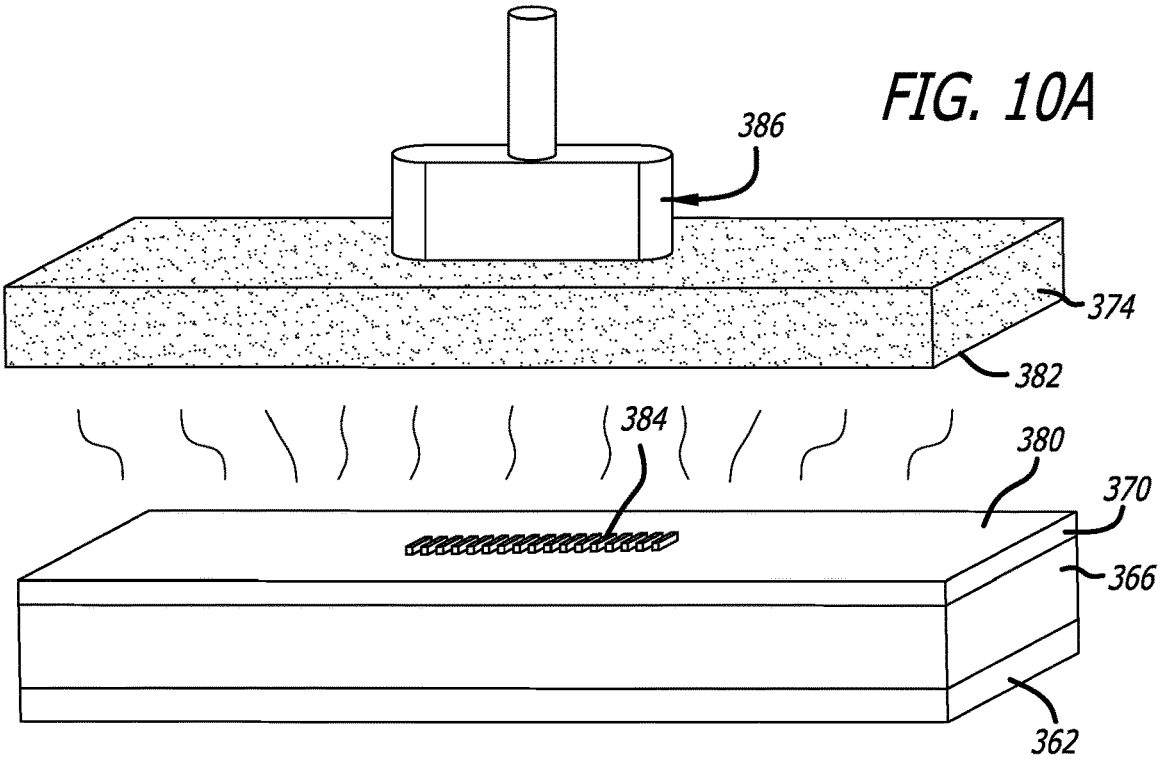
FIG. 10A is a perspective view that illustrates a portion of a process for forming another embodiment of a cleaning column.
Figure 10B:
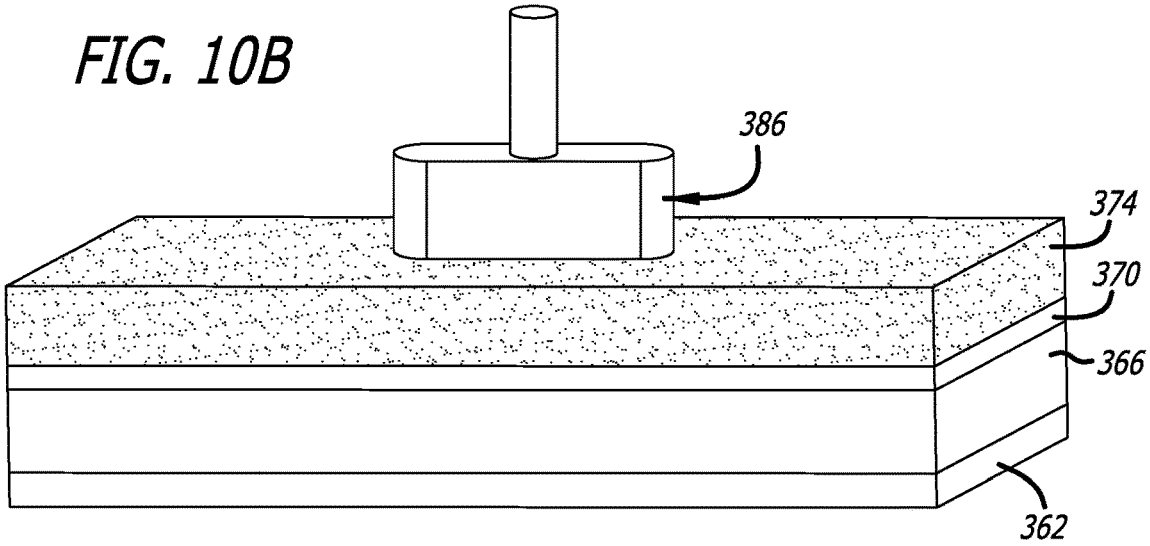
FIG. 10B is a perspective view that illustrates another portion of the process started in FIG. 10A.
Figure 10C:
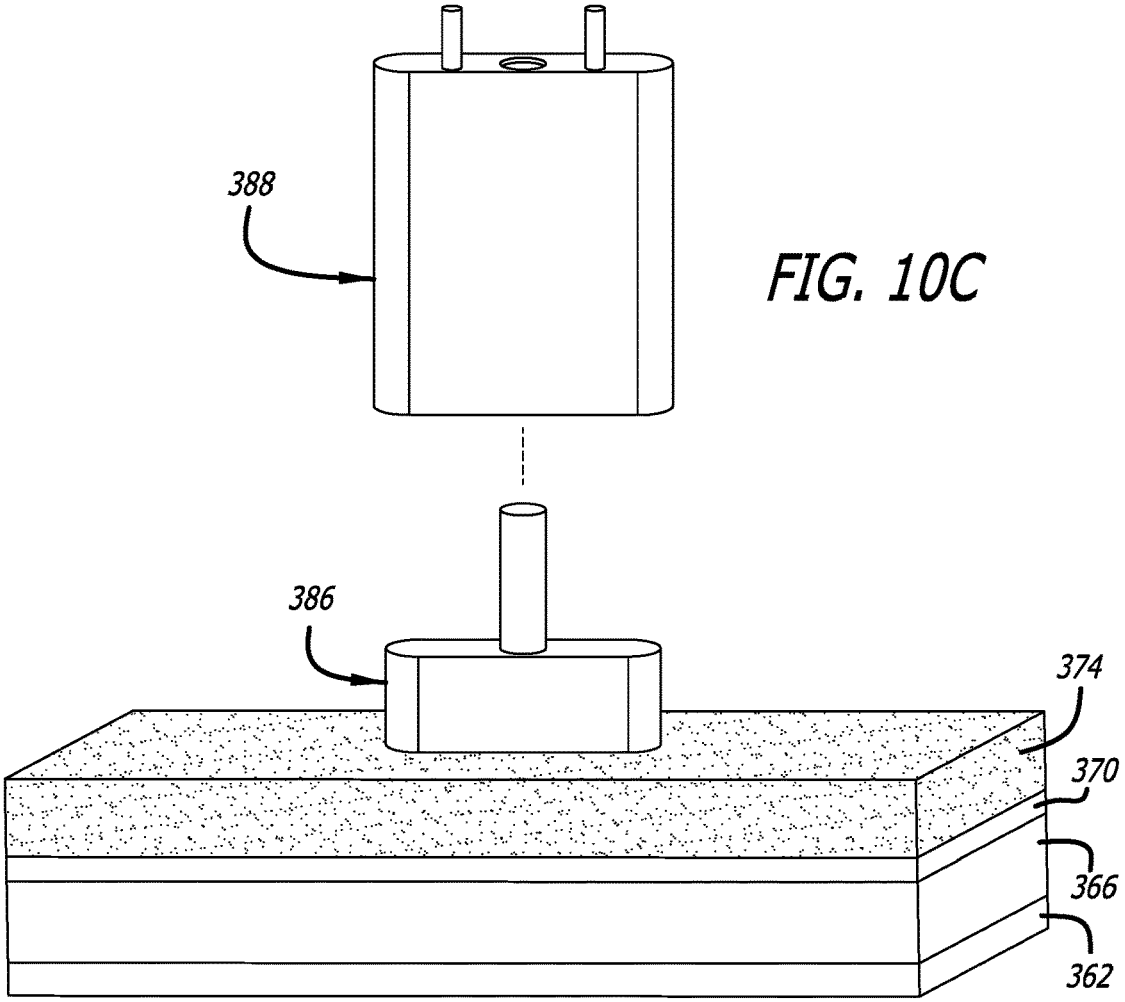
FIG. 10C is a perspective view that illustrates yet another portion of the process started in FIG. 10A.
Figure 10D:
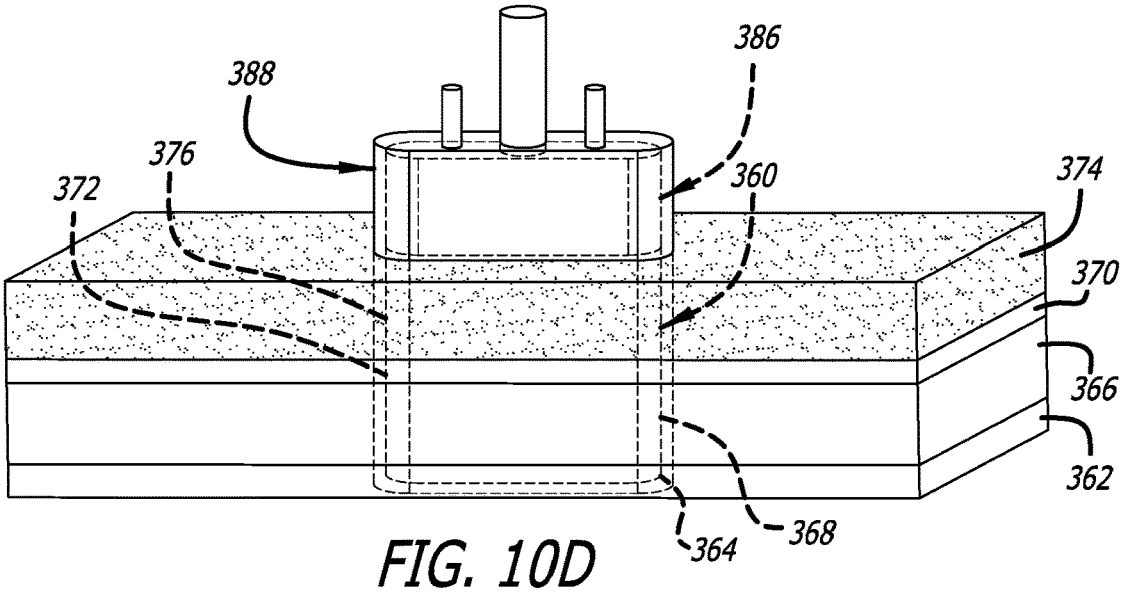
FIG. 10D is a perspective view that illustrates yet still another portion of the process started in FIG. 10A.

FIGS. 10A-10D depicts assembling sheets of the polymeric materials prior to die cutting to form a cleaning column 360. A first sheet 362 corresponding to a first base portion 364, a second sheet 366 corresponding to a second base portion 368, a third sheet 370 corresponding to an intermediate portion 372, and a fourth sheet 374 corresponding to an upper portion 376 are provided. As depicted in FIG. 10A, after assembly of attachment of the first sheet 362, the second sheet 366, and the third sheet 370 to one another, the fourth sheet 374 can be joined to the third sheet 370. The third sheet 370 includes an upper surface 380 and the fourth sheet 374 includes a lower surface 382, and, as depicted in FIG. 10A, heat can be applied to the upper surface 380 and the lower surface 382 and/or to the area between the upper surface 380 and the lower surface 382, and weld ribs 384 can be positioned between upper surface 380 and the lower surface 382. Thereafter, as depicted in FIG. 10B, a press 386 is used to press the fourth sheet 374 onto the third sheet 370 to join the upper surface 380 and the lower surface 382 to one another. For example, the upper surface 350 can be heated to a temperature of 450° F. for 7 seconds, and then the upper portion 348 can be pressed onto the upper surface 350 using the press 356 for 5 seconds. The air pressure and dwell time can also be controlled to facilitate attachment of the fourth sheet 374 to the third sheet 370. As depicted in FIGS. 10C and 10D, the press 386 can then serve as a guide for facilitating placement of a foam die cutter 388. The foam die cutter 388 can be received over the press 386 and cut into the first sheet 362, the second sheet 366, the third sheet 370, and the fourth sheet 374 to form the cleaning column 360. Use of the foam die cutter 388 does not afford providing the portions of the cleaning column 360 with a taper such as that of cleaning columns 280, 280', and 340.

Figure 11A:
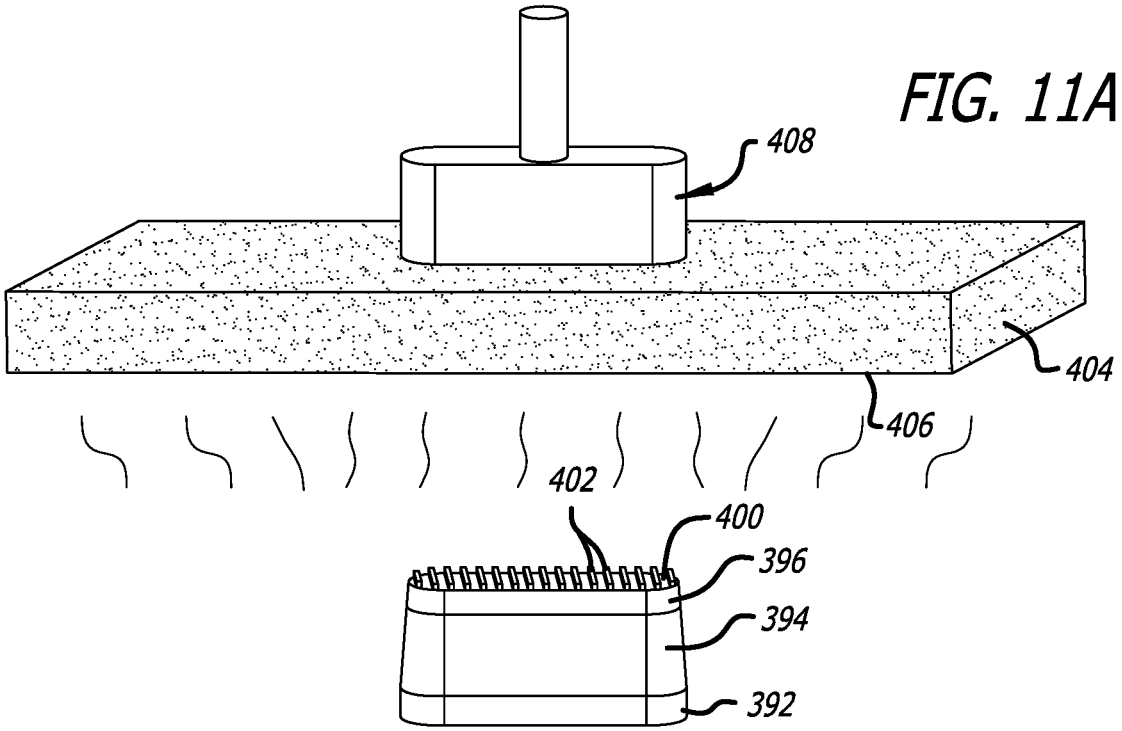
FIG. 11A is a perspective view that illustrates a portion of a process for forming another embodiment of a cleaning column.
Figure 11B:
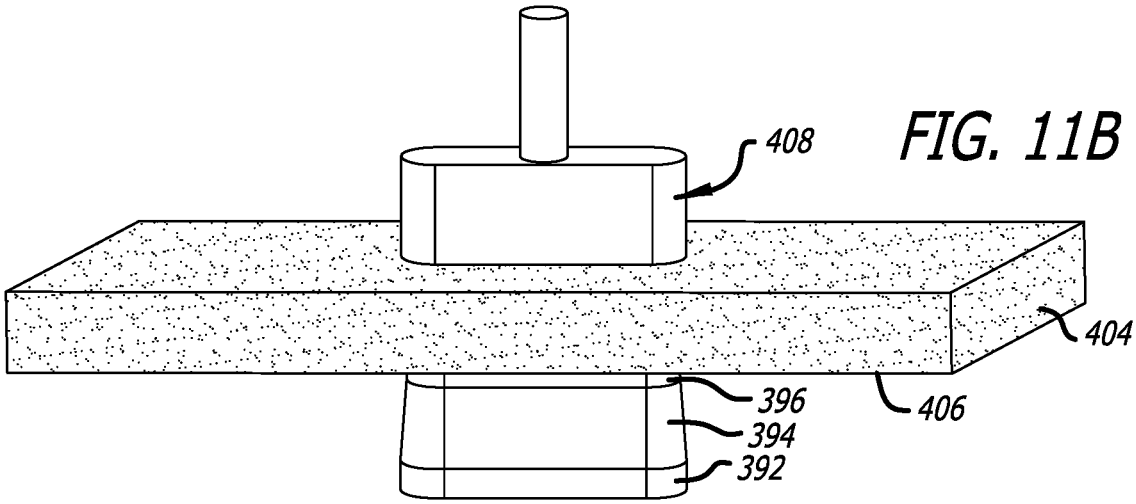
FIG. 11B is a perspective view that illustrates another portion of the process started in FIG. 11A.
Figure 11C:
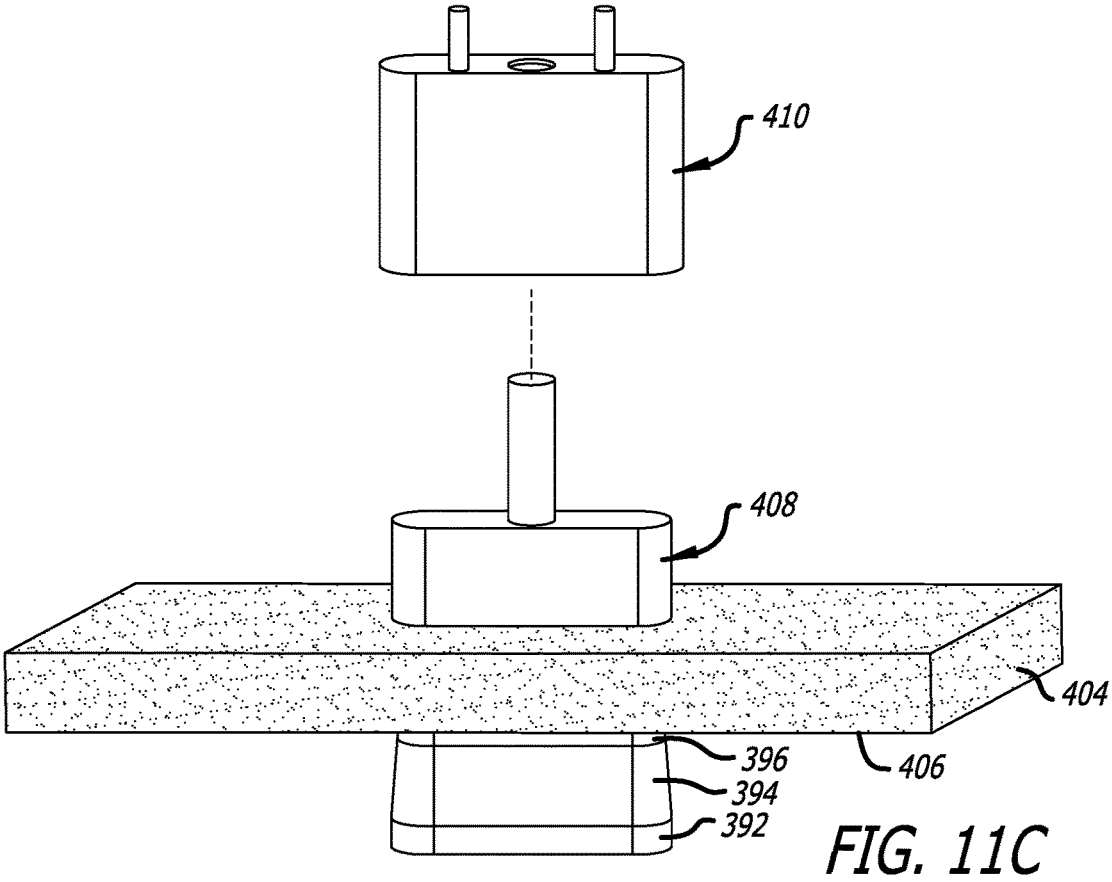
FIG. 11C is a perspective view that illustrates yet another portion of the process started in FIG. 11A.
Figure 11D:
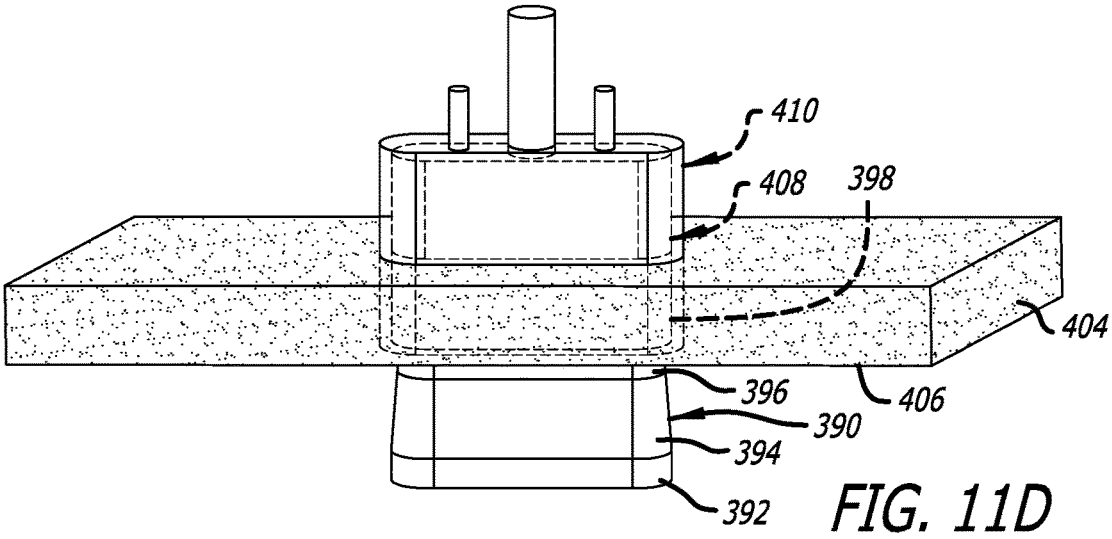
FIG. 11D is a perspective view that illustrates yet still another portion of the process started in FIG. 11A.

FIGS. 11A-11D depict a cleaning column 390 (similar to cleaning columns 280, 280', and 340), and a method of assembling portions thereof. The method depicted in FIGS. 11A-11D relies on portions of the methods described in FIGS. 7A-9 and FIGS. 10A-10D. The cleaning column 390 includes a first base portion 392, a second base portion 394, an intermediate portion 396, and an upper portion 398. The first base portion 392, the second base portion 394, and the intermediate portion 396 can be created using die cutting on sheets of polymeric materials, and the upper portion 398 can be formed using the method of FIGS. 11A-11D. The intermediate portion 396 includes an upper surface 400 having various ridges 402 formed thereon. Furthermore, a sheet of polymeric material 404 (that ultimately is die cut to form the upper portion 398) can be joined to the intermediate portion 396 by applying heat or by another welding process or attachment method to the upper surface 400 and/or to the area between the intermediate portion 346 and the upper portion 438, and, thereafter, pressing the sheet 404 onto the upper surface 400 of the intermediate portion 396 using a press. For example, the upper surface 400 can be heated to a temperature of 450° F. for 7 seconds, and then the upper portion 398 can be pressed onto the upper surface 400 using the press 408 for 5 seconds. The air pressure and dwell time can also be controlled to facilitate attachment of the sheet 404 to the intermediate portion 396. The heat can also be transferred by a non-contact process, which would be generally preferred in the case of an elastomer material to prevent residue build up on the heat platen. The welding process, heat, and dwell time can be adjusted according to whether a contact or non-contact process is preferred. As such, a lower surface 406 of the sheet 404 would be welded onto the upper surface 400 of the intermediate portion 396. As depicted in FIGS. 11A and 11B, the press 408 can then serve as a guide for facilitating placement of a foam die cutter 410. The foam die cutter 410 can be received over the press 408 and cut into the sheet 404 to form the upper portion 398.

Figure 12A:
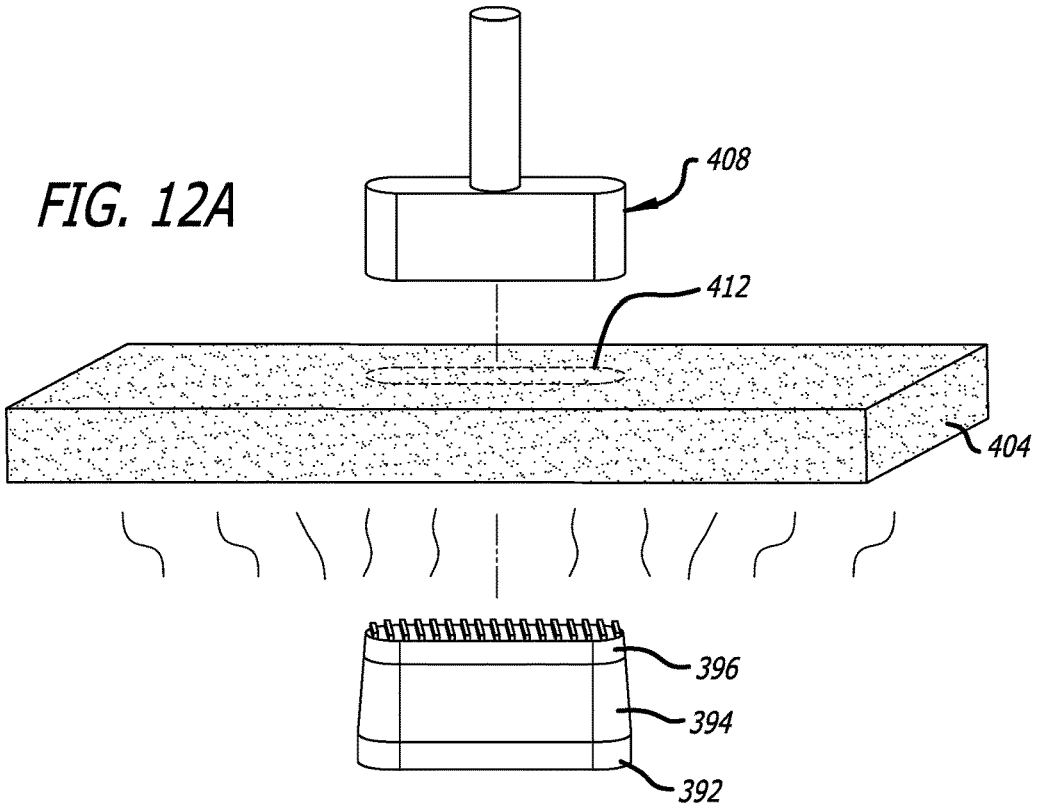
FIG. 12A is a perspective view that illustrates a modified version of the process started in FIG. 11A.
Figure 12B:
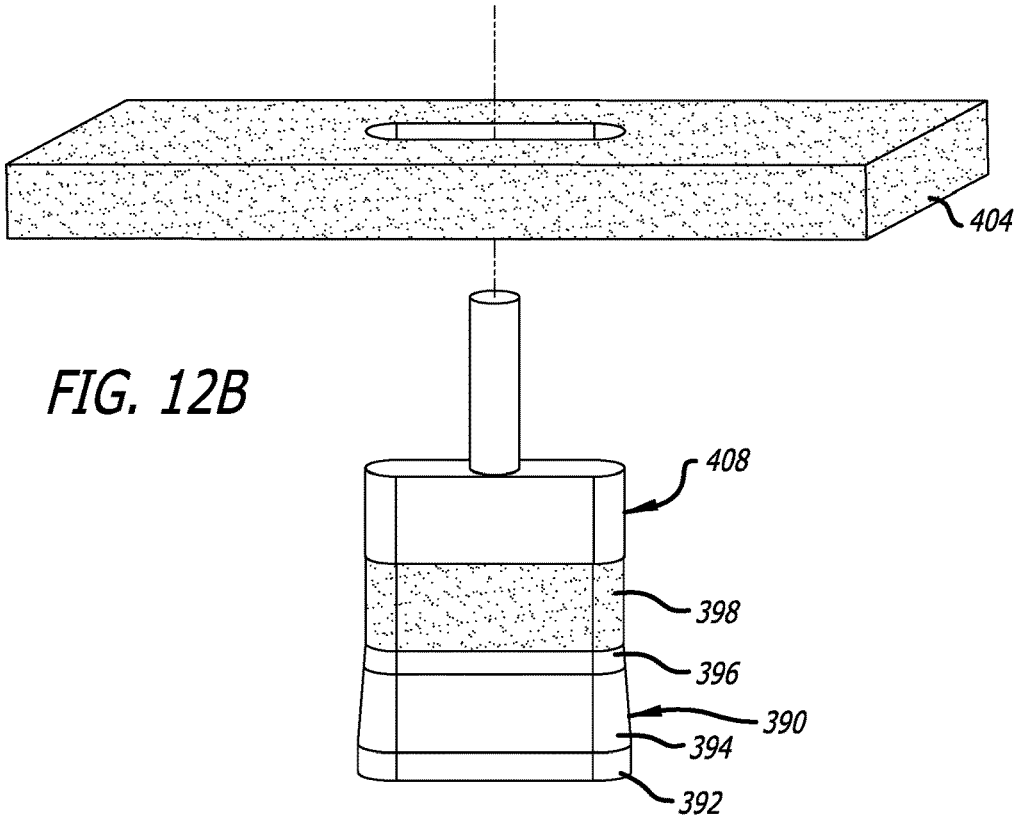
FIG. 12B is another perspective view that illustrates a modified version of the process started in FIG. 11A.

Rather than using the foam die cutter 410 to form the upper portion 398, the sheet 404, as depicted in FIGS. 12A and 12B, can come precut along cut lines 412, and, when the foam sheet 404 is pressed onto the intermediate portion 396, the upper portion 398 is effectively removed from the remainder of the foam sheet 404.

It should be understood that various aspects disclosed herein may be combined in different combinations than the combinations specifically presented in the description and the accompanying drawings. It should also be understood that, depending on the example, certain acts or events of any of the processes or methods described herein may be performed in a different sequence, may be added, merged, or left out altogether (e.g., all described acts or events may not be necessary to carry out the techniques). In addition, while certain aspects of this disclosure are described as being performed by a single module or unit for purposes of clarity, it should be understood that the techniques of this disclosure may be performed by a combination of units or modules.

We claim:

1. A toothbrush comprising:

a first end and an opposite second end, and a mid-longitudinal axis extending through the first end and the second end;

a handle portion extending from the first end toward the second end, the handle portion having an upper surface and an opposite lower surface;

a head portion extending from the second end toward the first end, the head portion having an upper surface and an opposite lower surface; and a cleaning column extending away from the upper surface of the head portion and being attached to the head portion, the cleaning column comprising an upper portion, a base portion, a welded area where the upper portion and the base portion are welded to one another, and an upper surface formed on the upper portion for contacting a user's teeth, the upper portion being formed of a first polymer portion, the base portion being formed of a second polymer portion, the first polymer portion being a polyurethane foam having a reticulated cell structure at the upper surface formed on the upper portion, and the welded area formed of portions of the second polymer portion of the base portion melted into portions of the reticulated cell structure of the first polymer portion of the upper portion.

2. The toothbrush of claim 1, wherein the first polymer portion of the upper portion exhibits an average linear cell count of about 70 to about 140 pores per-linear-inch and a density from about 1 to about 8 pounds per cubic foot.

3. The toothbrush of claim 2, wherein the second polymer portion of the base portion has a hardness ranging from about 0 on the Shore A scale up to about 70 on the Shore A scale.

4. The toothbrush of claim 2, wherein the second polymer portion of the base portion is formed at least in part via a compression process to increase stiffness, the base portion having a hardness ranging from about 0 on the Shore A scale up to about 70 on the Shore A scale.

5. The toothbrush of claim 1, wherein the first polymer portion of the upper portion is formed from one of a polyether based polyurethane and a polyester based polyurethane.

6. The toothbrush of claim 1, wherein the first polymer portion of the upper portion has a thickness measured from the upper surface of the upper portion toward the upper surface of the head portion of between 1 and 10 millimeters.

7. The toothbrush of claim 1, wherein the upper surface of the upper portion has pockets formed therein from a porous structure of the foam, the pockets being capable of retaining dentifrice therein.

8. The toothbrush of claim 1, further comprising one or more of antibacterial agents, surfactant agents, fluoride, flavoring substances, anti-yellowing agents, and plaque indicators mixed in with the foam of the first polymer portion of the upper portion during construction thereof.

9. The toothbrush of claim 1, further comprising one or more of antibacterial agents, surfactant agents, fluoride, flavoring substances, anti-yellowing agents, and plaque indicators added to the foam of the first polymer portion of the upper portion.

10. The toothbrush of claim 1, wherein the cleaning column is positioned in the center of the upper surface of the head portion and has a long axis substantially aligned with the mid-longitudinal axis of the toothbrush, the cleaning column having a first end oriented toward the first end of the toothbrush, a second end oriented toward the second end of the toothbrush, a first lateral side and an opposite second lateral side each extending between the first end and the second end of the cleaning column; and further comprising a set of tufts of cleaning bristles extending upward from the upper surface of the head portion, the set of tufts of cleaning bristles being positioned adjacent the cleaning column to at least partially surround the cleaning column.

11. The toothbrush of claim 1, wherein the base portion includes a lower surface attached to the upper surface of the head portion via at least one of adhesive, a mechanical fastener, melting, ultrasonic welding, or press fitting.

12. The toothbrush of claim 1, wherein the cleaning column is removable from the head portion of the toothbrush to permit a new cleaning column to be attached to the head portion.

13. The toothbrush of claim 1, wherein the head portion and cleaning column are removable as a unit from the toothbrush to permit a new head portion and a new cleaning column to be attached to the toothbrush as a new unit.

14. A toothbrush comprising:

a first end and an opposite second end, and a mid-longitudinal axis extending through the first end and the second end;

a handle portion extending from the first end toward the second end, the handle portion having an upper surface and an opposite lower surface;

a head portion extending from the second end toward the first end, the head portion having an upper surface and an opposite lower surface; and a cleaning column extending away from the upper surface of the head portion and being attached to the head portion, the cleaning column having a lower surface attached to the head portion and an upper surface for contacting a user's teeth, the cleaning column comprising:

an upper portion including the upper surface of the cleaning column, the upper portion being formed of a first polymer portion, the first polymer portion being a polyurethane foam having a reticulated cell structure with free strands adapted to clean teeth at the upper surface of the cleaning column;

a base portion including the lower surface of the cleaning column, the base portion being positioned between the head portion and the upper portion, the base portion being formed of a second polymer portion, the second polymer portion having a hardness greater than the hardness of the upper portion; and a welded area where the upper portion and the base portion are welded to one another, the welded area formed of portions of the second polymer portion of the base portion melted into portions of the reticulated cell structure of the first polymer portion of the upper portion.

15. The toothbrush of claim 14, wherein the upper surface of the cleaning column has pockets formed therein from a porous structure of the foam, the pockets being capable of retaining dentifrice therein.

16. The toothbrush of claim 15, wherein the first polymer portion of the upper portion exhibits an average linear cell count of about 70 to about 140 pores per-linear-inch and a density from about 1 to about 8 pounds per cubic foot.

17. The toothbrush of claim 16, wherein the first polymer portion of the upper portion is formed from one of a polyether based polyurethane and a polyester based polyurethane.

18. The toothbrush of claim 14, further comprising one or more of antibacterial agents, surfactant agents, fluoride, flavoring substances, anti-yellowing agents, and plaque indicators mixed in with the foam of the first polymer portion of the upper portion during construction thereof.

19. The toothbrush of claim 14, further comprising one or more of antibacterial agents, surfactant agents, fluoride, flavoring substances, anti-yellowing agents, and plaque indicators added to the foam of the first polymer portion of the upper portion.

20. The toothbrush of claim 14, wherein the cleaning column is positioned in the center of the upper surface of the head portion and has a long axis substantially aligned with the mid-longitudinal axis of the toothbrush, the cleaning column having a first end oriented toward the first end of the toothbrush, a second end oriented toward the second end of the toothbrush, a first lateral side and an opposite second lateral side each extending between the first end and the second end of the cleaning column; and further comprising a set of tufts of cleaning bristles extending upwardly from the upper surface of the head portion, the set of tufts of cleaning bristles being positioned adjacent the cleaning column to at least partially surround the cleaning column.

21. The toothbrush of claim 14, wherein the lower surface of the cleaning column is attached to the upper surface of the head via at least one of adhesive, a mechanical fastener, melting, ultrasonic welding, or press fitting.

22. The toothbrush of claim 14, wherein the cleaning column is removable from the head portion of the toothbrush to permit a new cleaning column to be attached to the head portion.

23. The toothbrush of claim 14, wherein the head portion and cleaning column are removable as a unit from the toothbrush to permit a new head portion and a new cleaning column to be attached to the toothbrush as a new unit.

24. The toothbrush of claim 14, wherein the second polymer portion of the base portion has a hardness ranging from about 0 on the Shore A scale up to about 70 on the Shore A scale.

25. A toothbrush comprising:

a first end and an opposite second end, and a mid-longitudinal axis extending through the first end and the second end;

a handle portion extending from the first end toward the second end, the handle portion having an upper surface and an opposite lower surface;

a head portion extending from the second end toward the first end, the head portion having an upper surface and an opposite lower surface; and a cleaning column extending away from the upper surface of the head portion and being attached to the head portion, the cleaning column having a lower surface attached to the head portion and an upper surface for contacting a user's teeth, the cleaning column comprising:

an upper portion including the upper surface of the cleaning column, the upper portion being formed of a first polyurethane portion, the first polyurethane portion being a foam having a reticulated cell structure with free strands adapted to clean teeth at the upper surface of the cleaning column;

a base portion including the lower surface of the cleaning column, the base portion being positioned between the head portion and the upper portion, the base portion being formed of a second polyurethane portion, the second polyurethane portion having a hardness greater than the hardness of the upper portion; and a welded area where the upper portion and the base portion are welded to one another, the welded area formed of portions of the second polyurethane portion of the base portion melted into portions of the reticulated cell structure of the first polyurethane portion of the upper portion.

* * * * *